US006579194B1

(12) United States Patent
Curry

(10) Patent No.: US 6,579,194 B1
(45) Date of Patent: Jun. 17, 2003

(54) PUTTER HEAD

(76) Inventor: David W. Curry, 741 Remington Ave., Thomasville, GA (US) 31792

( * ) Notice: Subject to any disclaimer, the term of this patent is extended or adjusted under 35 U.S.C. 154(b) by 0 days.

(21) Appl. No.: 09/659,372

(22) Filed: Sep. 12, 2000

Related U.S. Application Data

(63) Continuation of application No. 09/659,372, filed on Sep. 12, 2000.
(60) Provisional application No. 60/153,214, filed on Sep. 13, 1999.

(51) Int. Cl.[7] ..... A63B 53/04
(52) U.S. Cl. ..... 473/328; 473/340; 473/341
(58) Field of Search ..... 473/251, 256, 473/313, 314, 324, 328, 332, 334, 335, 340, 341, 349, 350, 248, 243, 231

(56) References Cited

U.S. PATENT DOCUMENTS 1,993,334 A * 3/1935 Mountbatten
D232,316 S * 8/1974 Cook
4,795,157 A * 1/1989 Bencriscutto
5,211,401 A * 5/1993 Hainey
5,246,231 A 9/1993 Antonious
5,344,149 A * 9/1994 Miller
5,460,375 A 10/1995 Hardee
5,464,215 A 11/1995 Koehler
5,746,665 A * 5/1998 Wenker
5,871,407 A * 2/1999 Tseng

* cited by examiner

*Primary Examiner*—S. Passaniti
(74) *Attorney, Agent, or Firm*—Carnes and Cona

(57) ABSTRACT

The present invention is a putter head having a rear face, a ball striking face, a heel area, a toe area, an upper area and a lower area. An attaching device is secured to the upper area to enable a conventional shaft to be secured thereto. Extending through the rear face and between the heel area and toe area is a cavity. The upper area of the cavity is smaller in size than the lower area of the cavity. The putter includes a sole having six planes. The six planes are equally proportioned planes of the sole and will release one quarter of one inch from a centerline of the lower area. This will provide for an overspin being imparted on the ball soon after impact. This will innately result in a truer roll and less margin for error in the ball rolling on line to the hole.

6 Claims, 4 Drawing Sheets

PUTTER HEAD

This is a continuation of copending application Ser. No. 09/659,372 filed on Sep. 12, 2000.

This is a utility Patent Application for Provisionally File Application No. 60/153,214 filed on Sep. 13, 1999.

BACKGROUND OF THE INVENTION

1. Field of the Invention

The present invention relates generally to golf putters, and more particularly to a putter head that includes a unique weight distribution and configuration for quickly enabling an overspin on the roll of the putt yet still provides a head that includes an overall construction that is substantially traditional in appearance.

2. Description of the Prior Art

Golfing is quickly growing in popularity and is a sport that is enjoyed by many. This particular sport is based strongly on skill, strength, mental discipline, and coordination. To improve their ability on the course, golfers have relentlessly tried several types of golfing equipment, which solely focuses on a particular area of weakness.

As such, golf equipment over the years has taken on a more precise approach to dimensional requirements to affect the final results of each individual shot with the ball. It has been learned that a small change in weight distribution, shape, mass, etc., can affect the preferred flight or path of the golf ball. Accordingly, many devices have been configured so as to improve and provide for an ultimate club and/or head.

One area of concern is putting. It is known that if a golfer hits numerous erratic tees and fairway shots, he can still achieve a suitable score if putting occurs accurately. Putting stokes normally account for at least half of the total score during a round of golf and it is definitely one phase of the golf game where a golfer can demonstrate individually.

In designing putters, methods are varied from designer to designer, and many concentrate on solving particular key areas, such as balance, feel and optimum roll. All would agree that achieving overspin on the roll of the putt as quickly as possible gives the golfer a better chance of positive results than skidding or bouncing of the ball at impact.

Many putters exist today that include lower weight in the head towards the sole. Prior research has proven that having the weight towards the top of the putter head increases the golfers chance of imparting more immediate overspin on the golf ball, thus decreasing the margin of error for missing a putt. However, these designs include a structure that is none aesthetically traditional from the eye of the golfer and thus may deter them from utilizing an apparatus, which may improve their game.

As seen, what is needed is a device that will achieve overspin on the roll of the putt as quickly as possible by providing a putter with lower weight in the heard towards the sole. This device should include an overall construction that is substantially traditional in appearance as conventional putters, so as to provide for a final product that is aesthetically tradition from the eye of the golfer utilizing the particular putter. In addition the head on the putter be simple in design and structure, so as to render an apparatus that can easily and successfully be utilized by a golfer and achieve the desired results. The present invention achieves the above noted needs.

Hence, it is seen that none of these previous efforts provide the benefits intended with the present invention, such as providing a putter head having a traditional shape yet includes a decrease in weight at the head towards the sole. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention is a putter head that is designed and configured having an increase in mass in the top of the top of the head so as to inherently provide for an overspin being imparted on the ball soon after impact. This will innately result in a truer roll and less margin for error in the ball rolling on line to the hole.

In order to provide for such a configuration, the present invention utilizes a cavity in the rear of the putter head that is wider at the bottom of the cavity and decreases in size toward the top of the cavity. This shape will aid in the removal of excess material form the bottom of the putt and relocate the excess to the top of the putter. In addition, the bottom sole of the putter will be fabricated from six individual planes. The planes will rise from the center point of the sole towards the toe and heel. This will place three planes on either side of the sole centerline. The use of planes will reduce the material used for forming the lower surface of the putter.

Altering the opening and lower surface will not adversely affect the overall appearance of the putter of the present invention. Thus the overall appearance will still be substantially the same as with traditional putters, but with the top weight being larger than conventional putters. Thereby, providing a final product that enhances performance.

Accordingly, it is the object of the present invention to provide for a novel and unique golf putter which will impart overspin on the golf ball roll of the putt as quickly as possible in order to enhance the golfers score by alleviating skidding or bouncing of the golf ball during the impact of the putt.

Still another object of the present invention is to provide for a putter with more weight towards the top of the putter, thereby imparting more immediate overspin on the golf ball during the putt.

A further object of the present invention is to provide for a putter, which will overcome the deficiencies, shortcomings, and drawbacks of prior putters and methods thereof.

Still another object of the present invention, to be specifically enumerated herein, is to provide a putter head in accordance with the preceding objects and which will conform to conventional forms of manufacture, be of simple construction and easy to use so as to provide a device that would be economically feasible, long lasting, properly customized and relatively trouble free in operation.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWING

Similar reference numerals refer to similar parts throughout the several views of the drawings.

DESCRIPTION OF THE PREFERRED EMBODIMENT

Figure 1A:
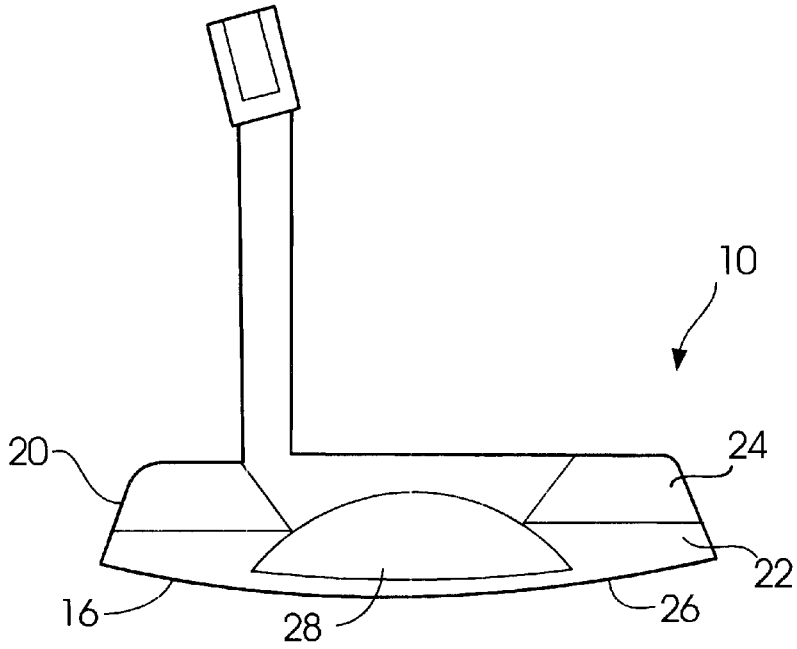
FIG. 1*a* is a rear elevational view of the putter head device of the present invention, illustrating a semi-circular cavity.
Figure 1B:
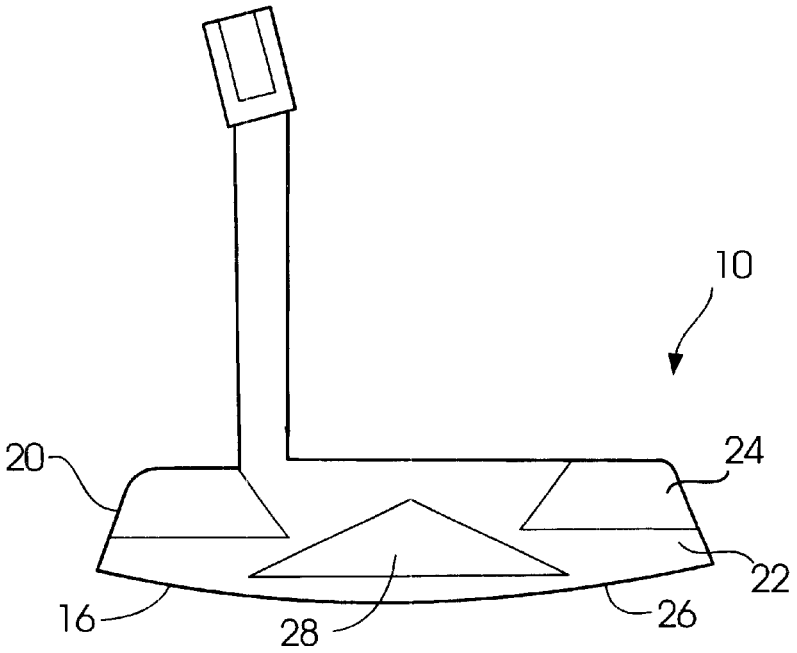
FIG. 1*b* is a rear elevational view of the putter head device of the present invention illustrating a triangular cavity.

As seen in the drawings, in particular to FIGS. 1*a*–6 there is shown a putter head device, denoted by reference numeral 10, that is designed and configured to achieve overspin on putts, yet have the appearance of conventional putters on the market today.

In order to achieve the such a configuration, the putter of the present invention is designed to re-distribute the mass of putter, by providing the mass of the weight to be located at the top area of the putter head. This will consequently reduce the weight located on the lower area of the putter.

The putter 10 as seen, includes a putter head body 12 having an attaching device 14 secured thereto. The putter head body is defined by a rear face 16 (see FIGS. 1*a,* 1*b* 4 and 5), a ball striking face 18 (see FIGS. 2, 4 and 5), a heel area 20 (see FIGS. 1*a* 1*b,* 2, 4 and 5) and a toe area 22 (see FIGS. 1, 2, 4 and 5). The putter head body further includes an upper ridge 24 and a sole or lower section 26, as shown in FIGS. 1, 2, 4 and 5. The lower section extends outwardly and substantially beyond the lower ridge 24. This is clearly seen in the top and side view of the putter device of the present invention, FIGS. 4 and 5, respectively.

Extending through the rear face 16 and between the heel area and toe area is a cavity 28. As seen in FIGS. 1*a,* 1*b,* 4, 5 and 6, the cavity bottom or floor will follow the line of the sole. The cavity, as seen, is wider at the bottom towards the sole and decreases in size towards the top of the cavity. Preferably, the shape is a half circle or a rounded off triangle. This will provide for the area of the top of the cavity to be smaller in size than the area of the bottom of the cavity. Such a design will remove material from the bottom of the putter head and will shift the weight mass of the putter head towards the top of the putter head body. This will ultimately permit only a minimal amount of material or weight in the bottom of the putter head. Indication marks can be used within the cavity for defining a central area therein.

Thereby, the overall design as illustrated in FIGS. 1*a*–6 provides for a traditional putter appearance, but with a top weight function which enhances performance. To further aid in the performance of the putter, and reducing the amount of material used in fabricating the sole of the putter, innately reducing the weight of the sole in comparison to conventional putters, the sole includes a unique design and configuration.

Figure 2:
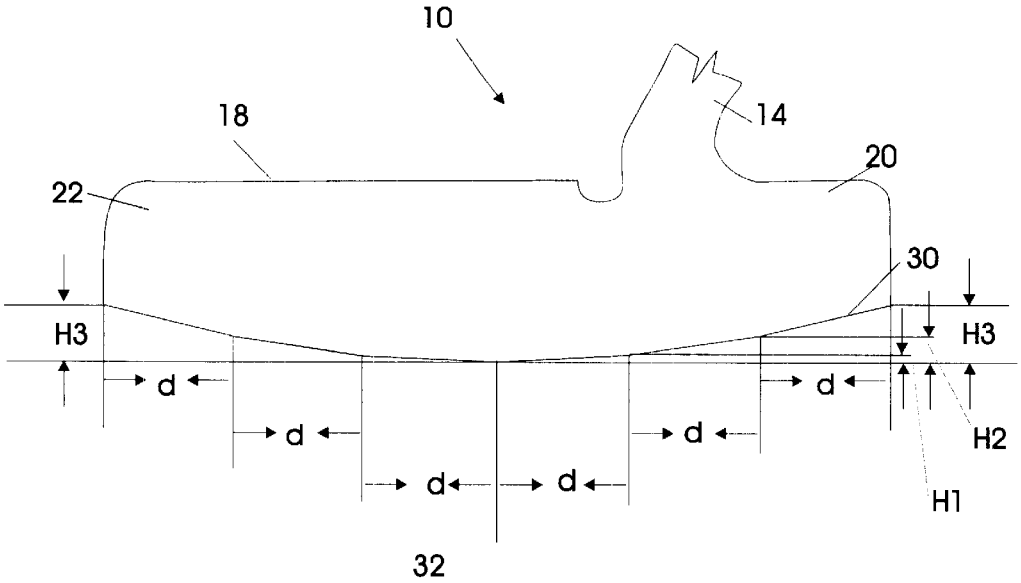
FIG. 2 is side elevational view of the sole from perspective of the center line of the sole rising to the heel and toe of the putter head device of the present invention.
Figure 3:
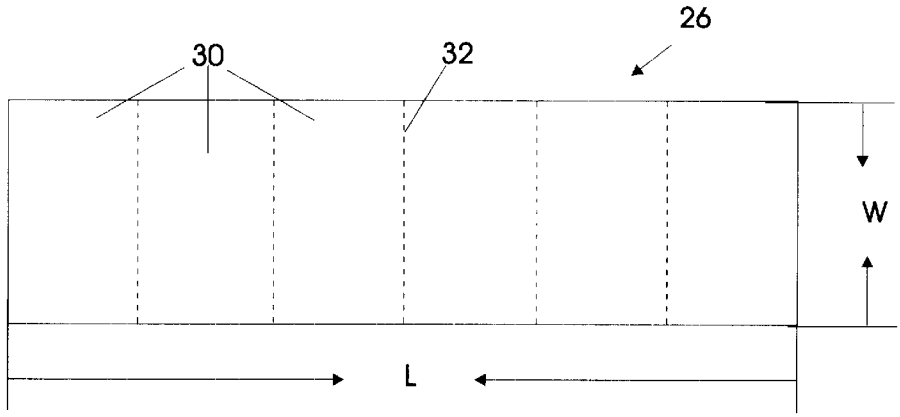
FIG. 3 is a bottom view of the putter head device of the present invention.
Figure 4:
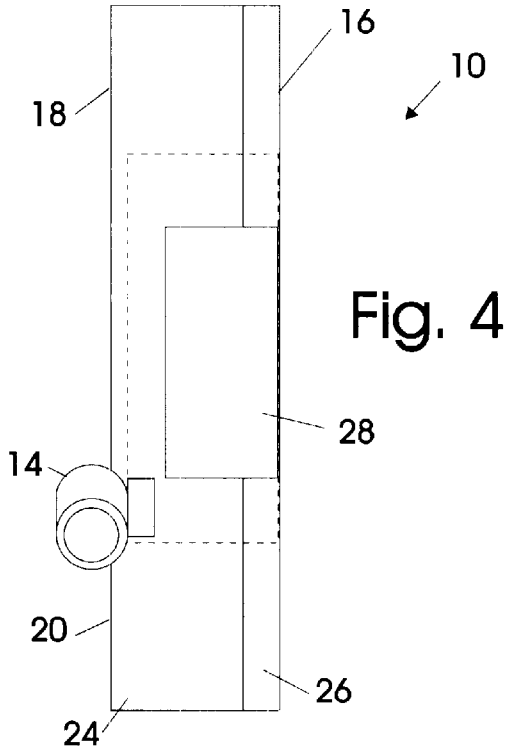
FIG. 4 is a top view of the putter head device of the present invention.
Figure 5:
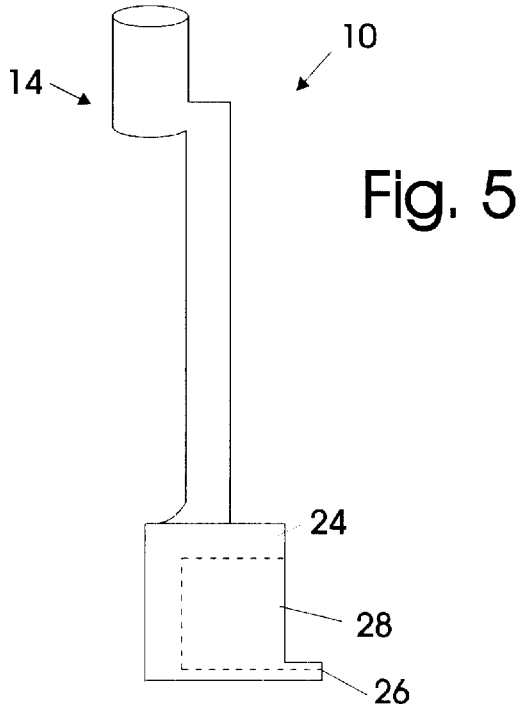
FIG. 5 is a side view of the putter head device of the present invention.
Figure 6:
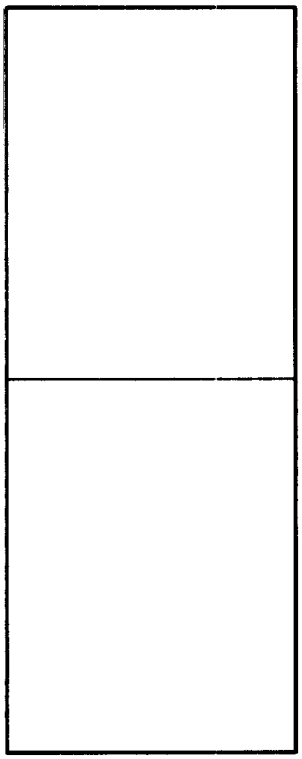
FIG. 6 is a top view of the cavity illustrating indications located therein.

As seen in FIGS. 2 and 3, the sole 26 comprises a plurality of individual planes 30 of equal dimension d. The planes, which rise from the center point 32 of the sole 26 towards the toe area 22 and heel area 20. In the preferred embodiment, the number of planes included six to provide for three planes to rise equidistantly from the sole centerline towards the toe and heel. Ideally, and preferably, the six equally proportioned planes of the sole will release one quarter of one inch (see reference H3 in FIG. 2) from the center point 32 of the sole to both the heel end and toe end. This will eliminate the curved lower sole of conventional putters and thus will reduce the amount of materials generally associated with fabricating the lower portion of a putter. Thus reducing the weight of the lower area of the putter, while increasing the weight of the upper area. As seen in FIG. 3, the putter will have an overall length L, preferably four to four and one-half inch and a width W that will vary per individual models.

As way of example, a putter has been fabricated, which has proven to be successful in increasing the weight of the upper portion in comparison to the lower portion. This putter that has been fabricated to include a length L (see FIG. 4) of 4.5 inches. This provided for the planes to each are 0.75 inches in length (dimension d of FIG. 2). This will provide for a first side comprising of three planes and a second side comprising of three planes. The first side of the planes is located at the heel area while the second side of planes to be located at the toe area. Each side is equivalent. Thus in forming the sole of the putter, from the center line 32, the first plane from the first side and the first plane from the second side are attached to provide for the height from the top of first plane to the bottom of the center line to be 0.0275 inches (H1), with respect to the particular end. The second plane from the first side and the second plane from the second side would be attached to the first plane to provide for height from the top of the second plane to the bottom of the center line to be 0.1104 inches (H2) with respect to the particular end. The third plane from the first side and the third plane from the second side would be attached to the second plane to provide for height from the top of the third plane to the bottom of the center line to be 0.25 inches (H3) with respect to the particular end.

The attaching device 14 can be any conventional device used for attaching a shaft onto a head. This attaching device can be channel for receiving a lower end of a shaft of a golf club, known as a hosel. The attaching device, as seen will be offset from the center to provide for the attaching device 14 to be located within the heel area 20.

While the invention has been particularly an embodiment thereof, it will be understood by those skilled in the art that various changes in form and detail may be the invention made without departing from the spirit and scope of present invention.

I claim:

1. A new and improved golf putter head adapted for placing top-spin on a golf ball, said head comprising:

a putter head body;

said putter head body including a rear face, a ball striking face perpendicular to the direction of impact of a golf ball when addressed, a heel area, a toe area, an upper area and a lower area;

an attaching device secured to said upper area and said attaching device enabling a shaft to be secured thereto;

a cavity extending across said rear face and between said heel area and said toe area;

said cavity including an upper section and a lower section;

said upper section being smaller in size than said lower section in order to make said upper area of said putter head body larger in mass than said lower area, thereby providing a larger mass of said putter head in said ball striking face and above the equator of said golf ball when addressed by said putter head manner.

2. A putter head as in claim 1 wherein said cavity is a semi-circular configuration for enabling movement of mass to said upper area of said putter head body, and wherein said lower portion includes a sole comprising a plurality of individual planes of equal dimension wherein three of said planes rise equidistantly from a sole centerline towards said heel area and three of said planes rise equidistantly from said sole centerline towards said toe area, such that the mass of said putter head is further reduced on the lower portion thereof with respect to the upper portion thereof.

3. A putter head as in claim 1 wherein said cavity is a triangular configuration for enabling movement of mass to said upper area of said putter head body, and wherein said lower portion includes a sole comprising a plurality of individual planes of equal dimension wherein three of said planes rise equidistantly from a sole centerline towards said heel area and three of said planes rise equidistantly from said sole centerline towards said toe area, such that the mass of said putter head is further reduced on the lower portion thereof with respect to the upper portion thereof.

4. A putter head as in claim 1 wherein said cavity includes indication marks.

5. A new and improved golf putter head adapted for placing top-spin on a golf ball, said head comprising:

a putter head body;

said putter head body including a rear face, a ball striking face perpendicular to the direction of impact of a golf ball when addressed, a heel area, a toe area, an upper area and a lower area;

an attaching device secured to said upper area and said attaching device enables a shaft to be secured thereto; and said lower portion including a sole having a plurality of individual planes of equal dimension, wherein half of said planes rise equidistantly from a sole centerline towards said heel area and half of said planes rise equidistantly from a sole centerline towards said toe area, such that the mass of said putter head is further reduced on the lower portion thereof with respect to the upper portion thereof; and, a cavity extending across said rear face and between said heel area and said toe area and said cavity including an upper section and a lower section, wherein said upper section is smaller in size than said lower section thereby increasing the mass of said putter head in the upper portion thereof in order to provide an overall larger mass of said putter head in said ball striking face and above the equator of said golf ball when addressed.

6. A putter head as in claim 5 wherein said planes are equally proportional planes of said sole and will rise one-quarter inch from said center line.

* * * * *